US011235352B2

(12) United States Patent
Akiyama

(10) Patent No.: US 11,235,352 B2
(45) Date of Patent: Feb. 1, 2022

(54) CAPACITIVE MICROMACHINED ULTRASONIC TRANSDUCER AND MANUFACTURING METHOD THEREOF

(71) Applicant: CANON KABUSHIKI KAISHA, Tokyo (JP)

(72) Inventor: Takahiro Akiyama, Atsugi (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 25 days.

(21) Appl. No.: 16/425,600

(22) Filed: May 29, 2019

(65) Prior Publication Data

US 2019/0366382 A1 Dec. 5, 2019

(30) Foreign Application Priority Data

May 31, 2018 (JP) ..... JP2018-105483

(51) Int. Cl.
*B06B 1/02* (2006.01)

(52) U.S. Cl.
CPC ..... *B06B 1/0292* (2013.01)

(58) Field of Classification Search
CPC ..... B02B 1/0292
USPC ..... 310/300, 309
See application file for complete search history.

(56) References Cited

U.S. PATENT DOCUMENTS

2006/0004289 A1 1/2006 Tian
2006/0179640 A1* 8/2006 Machida ..... B06B 1/0292 29/594
2007/0052093 A1 3/2007 Machida
2011/0188104 A1* 8/2011 Tachibana ..... H02N 1/006 359/199.2
2012/0316445 A1 12/2012 Machida
2013/0241345 A1 9/2013 Takezaki
2016/0136686 A1* 5/2016 Brock-Fisher ..... A61B 8/4483 600/459

FOREIGN PATENT DOCUMENTS

JP 2007-74263 A 3/2007

* cited by examiner

*Primary Examiner* — Terrance L Kenerly
(74) *Attorney, Agent, or Firm* — Canon U.S.A., Inc. IP Division

(57) ABSTRACT

A high output and high reliability capacitive micromachined ultrasonic transducer (CMUT) is provided. The capacitive micromachined ultrasonic transducer has a concave portion on a surface of at least one insulating film. The surface faces an air gap.

28 Claims, 14 Drawing Sheets

CAPACITIVE MICROMACHINED ULTRASONIC TRANSDUCER AND MANUFACTURING METHOD THEREOF

BACKGROUND

Field

One disclosed aspect of the embodiments relates to a capacitive micromachined ultrasonic transducer and a manufacturing method thereof.

Description of the Related Art

Micro mechanical members can be manufactured at a size on the order of micrometers by micro machining techniques, and various micro functional elements are realized using the thus manufactured micro mechanical members. Capacitive micromachined ultrasonic transducers (CMUTs) manufactured by the micro machining techniques have been studied as substitutes of piezoelectric elements. This type of CMUTs can transmit and receive ultrasonic waves using vibration of vibrating membranes and can easily obtain excellent broadband characteristics especially in liquids. The CMUTs can shorten pulse lengths of generating ultrasonic waves by the broadband characteristics and thus improve spatial resolution. Further, even a case which conventionally requires evaluation by a plurality of ultrasonic probes, evaluation can be performed by a small number of the ultrasonic probes. Consequently, simplification and cost reduction of the apparatus can be achieved. The broadband characteristics are useful in imaging techniques using harmonics.

The CMUT generates an ultrasonic wave by applying a direct current (DC) voltage and an alternating current (AC) voltage between two electrodes forming capacitance and largely vibrating a vibrating membrane. On this occasion, there is a possibility that the vibrating membrane including one of the electrode comes into contact with a fixed part including the other electrode. In a case where the vibrating membrane comes into contact with the fixed part, there is only a thin insulating layer between the two electrodes. Consequently, electric charge passes through the insulating layer in response to an electric field applied to the insulating layer, and a weak current flows therethrough. Since the vibrating membrane continues vibration, the electric charge taken into the insulating film when the vibrating membrane is separated from the fixed part remains inside thereof, and the insulating film is charged. It is difficult to bring the insulating film once charged to an initial state, and a sensitivity characteristic of the CMUT with respect to an applied voltage is changed. In other words, performance is changed while the CMUT is continuously used, and thus long-term reliability is affected. As discussed in Japanese Patent Application Laid-Open No. 2007-74263, with respect to the above-described issues, there is a method for reducing a charge transfer amount by providing a protrusion under the vibrating membrane to reduce a contact area between the vibrating membrane and the fixed part.

The CMUT vibrates the vibrating membrane by an externally input AC voltage and thus generates an ultrasonic wave. An air gap is formed under the vibrating membrane, and the fixed part including the other electrode is formed under the air gap. Thus, in a case where an amplitude of the vibrating membrane becomes larger than a height of the air gap, the vibrating membrane comes into contact with the fixed part below the air gap. On this occasion, the insulating film is instantaneously applied with a large electric field and is charged by generated charge transfer. Charging changes the sensitivity characteristic of the CMUT, and thus long-term reliability thereof is deteriorated.

As a method for reducing charging, an applied voltage may be regulated to prevent the vibrating membrane from coming into contact with a surface of the fixed part at the bottom of the air gap. However, there is a possibility that the CMUT cannot generate an adequate transmission sound pressure since the amplitude of the vibrating membrane is restricted. While an electric field strength at the time of contact can be reduced in such a manner that a part of the insulating film is thickened, the amplitude of the vibrating membrane is also restricted. A configuration in which the electrodes are removed from immediately above and immediately below the contact portion can weaken the electric field strength applied to the insulating film at the time of contact and reduce a charge transfer amount. However, in a case where the electrode is not formed at a part at which a distance between the vibrating membrane and the fixed part is the closest, the sensitivity of the CMUT is lowered and, at the same time, a higher applied voltage is required to obtain a necessary transmission sound pressure. A magnitude of the applied voltage is naturally restricted from a dielectric strength voltage of an element, a voltage supply unit, an electrical circuit, and the like, and therefore there is a possibility that an adequate transmission sound pressure cannot be generated. Further, there is a method using a high resistance conductive material to a contact portion between the insulating film and the vibrating membrane to cause electric charge to outflow without remaining in the insulating film. An adjustment method for measuring a charge amount and changing an applied voltage depending on the measured charge amount can be applied, but in such a case, structures of an element and an apparatus may become complicated.

SUMMARY

According to an aspect of the embodiments, a capacitive micromachined ultrasonic transducer (CMUT) includes a first electrode, a first insulating film and a vibrating membrane. The first insulating film is located on the first electrode. The vibrating membrane is positioned across an air gap from the first insulating film. The vibrating membrane includes a second insulating film and a second electrode. The second insulating film is located at a position facing the air gap. A concave portion is located on at least either one of a surface of the first insulating film facing the air gap and a surface of the second insulating film facing the air gap.

According to another aspect of the embodiments, a method for manufacturing a capacitive micromachined ultrasonic transducer (CMUT) includes forming a first insulating film on a first electrode, forming a sacrificial layer on the first insulating film, forming a second insulating film on the sacrificial layer, forming a second electrode on the second insulating film, forming an etching hole by removing a part of the second insulating film to expose a part of the sacrificial layer, and forming an air gap by removing the sacrificial layer. The sacrificial layer is formed in such a manner that by removing the sacrificial layer, a concave portion is formed on a surface of the second insulating film facing the air gap.

According to yet another aspect of the embodiments, a method for manufacturing a capacitive micromachined ultrasonic transducer (CMUT) includes forming a first insulating film on a first electrode, forming a sacrificial layer on the first insulating film, forming a second insulating film on the sacrificial layer, forming a second electrode on the second insulating film, forming an etching hole by removing the second insulating film to expose a part of the sacrificial layer, and forming an air gap by removing the sacrificial layer. The sacrificial layer is formed in such a manner that by removing the sacrificial layer, a concave portion is formed on a surface of the first insulating film facing the air gap.

Further features of the disclosure will become apparent from the following description of exemplary embodiments with reference to the attached drawings.

DESCRIPTION OF THE EMBODIMENTS

Figure 1A:
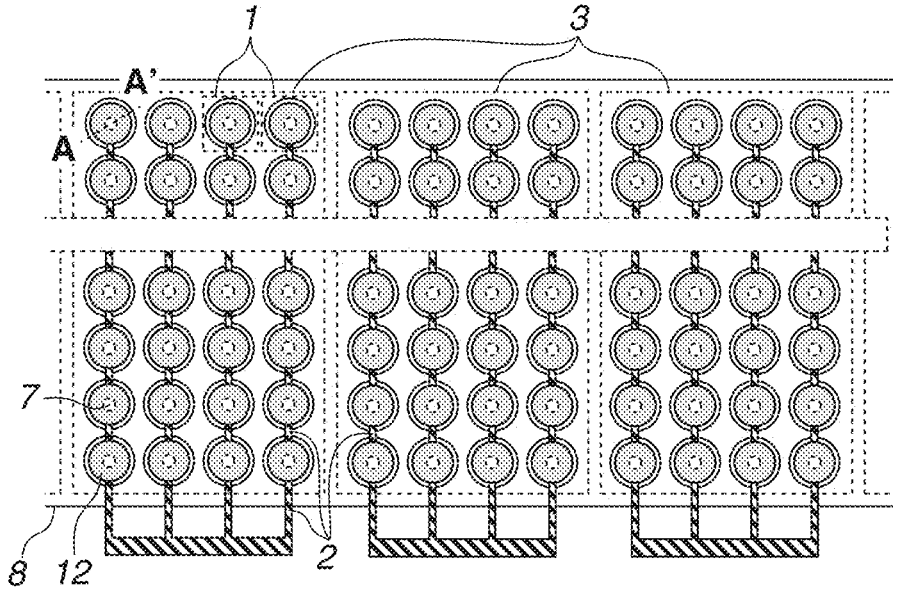
FIGS. 1A to 1C are diagrams illustrating a top view, a cross-sectional view taken along an A-A' line, and a cross-sectional view during driving, respectively, of a capacitive micromachined ultrasonic transducer (CMUT) according to exemplary embodiments.

A capacitive micromachined ultrasonic transducer (CMUT) according to an exemplary embodiment includes a first electrode, a first insulating film disposed on the first electrode, and a vibrating membrane disposed across an air gap from the first insulating film. The vibrating membrane includes a second insulating film and a second electrode and is disposed at a position facing the air gap. Further, a concave portion is disposed on at least either one of a surface of the first insulating film facing an air gap and a surface of the second insulating film facing the air gap.

An area in an in-plane direction of a region in which the concave portion is disposed is smaller than an area of a region in which the concave portion is not disposed.

Even if an amplitude of the vibrating membrane is increased to a degree that the vibrating membrane comes into contact with a surface of the first insulating film at a bottom of the air gap, a maximum displacement portion does not directly come into contact with the insulating film because of the concave portion. Accordingly, a vibration amplitude is not constrained, for example, by a convex portion, and a large amplitude can be therefore realized. Also, an ultrasonic wave having an adequate sound pressure can be generated. Further, since the vibrating membrane comes into contact with the insulating film at a surrounding portion of the concave portion, and a contact area is reduced, charging can be reduced. Accordingly, a high output CMUT in which charging is reduced can be provided.

According to the present exemplary embodiment, it is desirable that the concave portion is formed, disposed in a region including a position at which displacement of the vibrating membrane is the largest, when viewed from a direction perpendicular to a surface facing the air gap (a lamination direction of each layer).

A shape of the concave portion is not particularly limited and exemplified by circular, rectangular, and ellipse shapes, when viewed from the direction perpendicular to the surface facing the air gap.

In a case where the shape of the vibrating membrane is circular, when viewed from the direction perpendicular to the surface facing the air gap, it is desirable that the concave portion is formed, disposed in a region including a center of the vibrating membrane. In a case where the shape of the vibrating membrane is rectangular when viewed from the direction perpendicular to the surface facing the air gap, it is desirable that the concave portion is formed, disposed in a region including a point at which diagonal lines of the vibrating membrane intersect with each other.

While materials of the first insulating film and the second insulating film are not particularly limited, it is desirable that the first insulating film includes silicon oxide from a viewpoint of charging reduction, and the second insulating film includes silicon nitride from a viewpoint of a vibration characteristic of the vibrating membrane. It is desirable that both of the first insulating film and the second insulating film include silicon oxide from the viewpoint of charging reduction.

In a case of a configuration in which the concave portion is formed, disposed on the first insulating film and is not formed, disposed on the second insulating film, it is desirable that the second electrode has an opening portion, and the opening portion is formed, disposed at least in a region in which the concave portion is formed, disposed, when viewed from the direction perpendicular to the surface facing the air gap. It is further desirable that a protrusion is formed on a surface of the second insulating film facing the air gap and at a position overlapping the concave portion, when viewed from the direction perpendicular to the surface facing the air gap in the above-described configuration.

In a case of a configuration in which the concave portion is formed on the second insulating film and is not formed on the first insulating film, it is desirable that the first electrode has an opening portion, and the opening portion is formed at least in a region in which the concave portion is formed, when viewed from the direction perpendicular to the surface facing the air gap. It is further desirable that a protrusion is formed on a surface of the first insulating film facing the air gap and at a position overlapping the concave portion, when viewed from the direction perpendicular to the surface facing the air gap in the above-described configuration.

The protrusion may be formed on either one of the surface of the first insulating film facing the air gap and the surface of the second insulating film facing the air gap, regardless of the presence/absence of the opening portion. In the above-described configuration, it is desirable that the protrusion is provided on a position overlapping the concave portion, when viewed from the direction perpendicular to the surface facing the air gap.

The first electrode may be formed on a substrate. A third insulating film may be further formed on the second insulating film.

(Detailed Description of Example of CMUT)

Figure 1B:
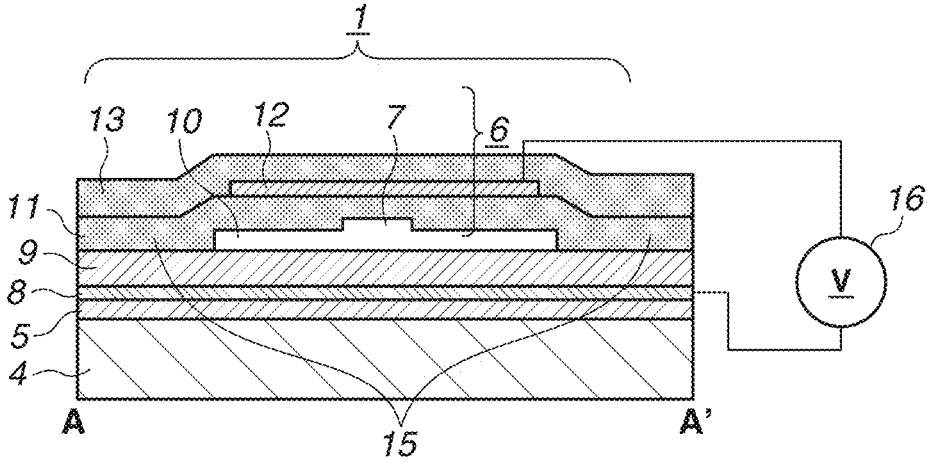
Figure 1C:
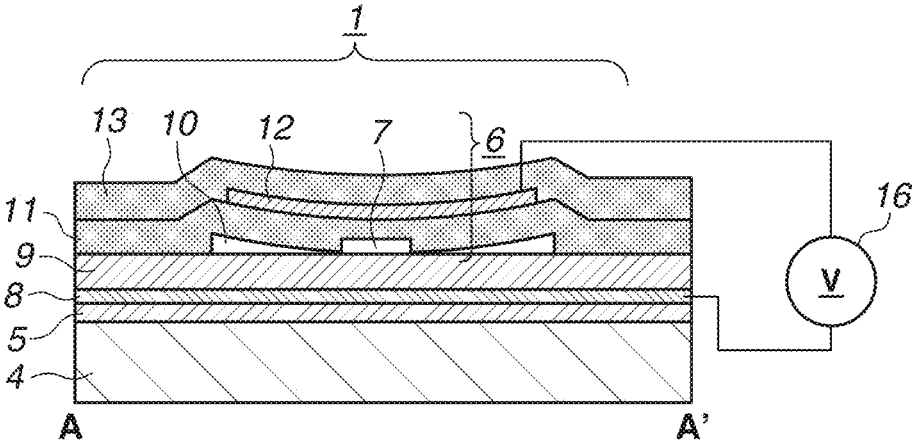

An exemplary embodiment is described in detail below with reference to FIGS. 1A to 1C. FIG. 1A is a top view illustrating a CMUT (simply referred to as a capacitive transducer in some cases) according to the present exemplary embodiment. FIG. 1B is a cross-sectional view of FIG. 1A taken along an A-A' line. FIG. 1C is a diagram illustrating a deformed shape of the vibrating membrane.

The CMUT according to the exemplary embodiment includes an element 3 including a plurality of cells 1. Each of the cells 1 included in the element 3 is electrically connected by a wire 2. In FIG. 1A, any number of the cells 1 may be included in the element 3. While the cells 1 in FIG. 1A is arranged in an equally spaced square lattice, the cells 1 may be arranged in a hexagonal close-packed lattice and an unequally spaced lattice. While a shape of a vibrating membrane 6 included in the cell 1 is circular in FIG. 1A, the shape may be polygonal, or rectangular, for example. The polygonal shape is not particularly limited and may be, for example, hexagonal.

A shape of the concave portion in a plane direction described below can be determined based on the shape of the cell. For example, in the case where the shape of the cell is circular, the shape of the concave portion can be circular, and in the case of rectangular, the shape of the concave portion can be rectangular or elliptical.

The cell 1 includes a first electrode 8 formed on a substrate 4, a first insulating film 9, an air gap 10, and the vibrating membrane 6. The vibrating membrane 6 includes a second insulating film 11, a second electrode 12, and a third insulating film 13, and is supported by a support portion 15 in such a manner that the vibrating membrane 6 is able to vibrate.

The capacitive ultrasonic transducer in FIG. 1A includes four elements 3. However, the number of elements 3 may be one or more, and there is no restriction on the number of the elements 3. In a case where a plurality of the elements 3 is included, one of the first electrode 8 and the second electrode 12 in the different elements is electrically separated. Further, either one of the first electrode 8 and the second electrode 12 may be shared by the plurality of the elements 3.

The first electrode 8 or the second electrode 12 is used as an electrode for applying a direct current (DC) bias voltage or an electrode for applying or taking out an electrical signal. The electrode for applying a bias voltage is shared in the element. The bias voltage may be shared in the element. However, electrodes for transmitting and receiving signals must be electrically separated in each element.

Materials configuring the cell 1 are described. The first electrode 8 is formed on the substrate 4. The substrate 4 is made of a silicon single crystal, silicon on insulator (SOI), glass, crystallized glass, quartz, silicon carbide, sapphire, gallium arsenide, gallium phosphide, gallium nitride, indium phosphide, and the like. The substrate 4 may include an integrated circuit. It is desirable that the first electrode 8 is made of metal, such as tungsten, molybdenum, titanium, aluminum, neodymium, chromium, cobalt, a lamination layer, compounds, and an alloy of these materials, and a compound and an alloy of these materials with silicon and copper. In addition, a semiconductor or a compound semiconductor including high concentrations of impurities may be used. In a case where the substrate 4 is not an insulating material, an insulating layer 5 made of, for example, silicon oxide and silicon nitride, is formed between the substrate 4 and the first electrode 8.

The air gap 10 is sealed in a state sufficiently depressurized compared with an atmospheric pressure. Sealing protects the air gap 10 from intrusion of liquid thereinto in a process after sealing or during use. In addition, since the air gap is depressurized, the sensitivity of the CMUT is enhanced. The first electrode 8 and the second electrode 12 are insulated by the insulating materials including the air gap 10. In the case of FIG. 1B, the first electrode 8 and the second electrode 12 are insulated by the first insulating film 9, the second insulating film 11, and the third insulating film 13. These insulating films 9, 11, and 13 are made of, for example, silicon oxide and silicon nitride. It is desirable that the second electrode 12 is made of metal such as tungsten, molybdenum, titanium, aluminum, neodymium, chromium, cobalt, a compound thereof, an alloy thereof, and a compound and an alloy of these materials with silicon and copper. Examples of alloys include an alloy of aluminum and neodymium, AlSiCu, and AlCu.

An operation principle of the CMUT according to the present exemplary embodiment is described. In a case where the CMUT transmits and receives an ultrasonic wave, a voltage applying unit 16 forms a potential difference between the first electrode 8 and the second electrode 12. In a case where a DC voltage and an alternating current (AC) voltage are applied between the first electrode 8 and the second electrode 12, the vibrating membrane 6 vibrates due to a temporal change of an electrostatic force. Vibration of the vibrating membrane is 10 kilohertz or more and 100 megahertz or less, for example, from several tens of kilohertz to several tens of megahertz, that is a frequency band of an ultrasonic wave. The principle is that an ultrasonic wave is generated by directly vibrating a material on the vibrating membrane. As described above, the CMUT according to the present exemplary embodiment converts an electrical signal into vibration of the vibrating membrane and can transmit an ultrasonic wave generated by the vibration.

Meanwhile, in a case where an ultrasonic wave is received, the vibrating membrane including the second electrode 12 vibrates, and electrostatic capacitance of the element 3 is changed. The change in the electrostatic capacitance causes an AC current to flow through the electrode for taking out an electrical signal. As described above, an ultrasonic wave is converted into an electrical signal, and thus the ultrasonic wave can be received. In the case of the CMUT, reception of an ultrasonic wave is output as a minute AC current due to the change in the electrostatic capacitance. The current is converted into an amplified voltage signal by a circuit such as an operational amplifier, dispersed by an analog-to-digital converter, and then subjected to signal processing.

An insulating film structure according to the present exemplary embodiment is described. In the CMUT in FIG. 1B, the second insulating film 11 includes a concave portion 7. The CMUT can transmits a larger sound pressure by largely vibrating the vibrating membrane 6 at the time of transmission. On this occasion, it is necessary to apply a larger AC voltage between the first electrode 8 and the second electrode 12. However, a height of the air gap 10 acts as a constraint, and an amplitude larger than the height cannot be obtained. In addition, there is a possibility that the vibrating membrane 6 comes into contact with a surface of the first insulating film 9 at a bottom of the air gap 10. In the case where the vibrating membrane 6 comes into contact with the surface at the bottom of the air gap 10, the first insulating film 9 and the second insulating film 11 locally come into contact with each other, and insulation property between the first electrode 8 and the second electrode 12 which is maintained high by the air gap 10 is deteriorated. In the contact region, a strong electric field is applied in the first insulating film 9 and the second insulating film 11, and charge transfer occurs. A part of the transferred charge passes through and is observed as a current flowing through the insulating film, and another part is taken into the insulating films. At the moment when the vibrating membrane 6 is separated from the surface at the bottom of the air gap 10, contact of the first insulating film 9 and the second insulating film 11 is released. At that moment, the electric field applied to the first insulating film 9 and the second insulating film 11 is rapidly weakened, and the electric charge taken into the insulating films remains in each of the insulating films. The charge remaining in the insulating film becomes an element forming a part of the electric field, so that transmission and reception sensitivity characteristics of the CMUT with respect to an applied voltage is changed before and after the vibrating membrane 6 comes into contact with the surface at the bottom of the air gap 10. If it is assumed that the CMUT is used over a long period, the change in the sensitivity characteristics largely affects the long-term reliability.

Figure 3:
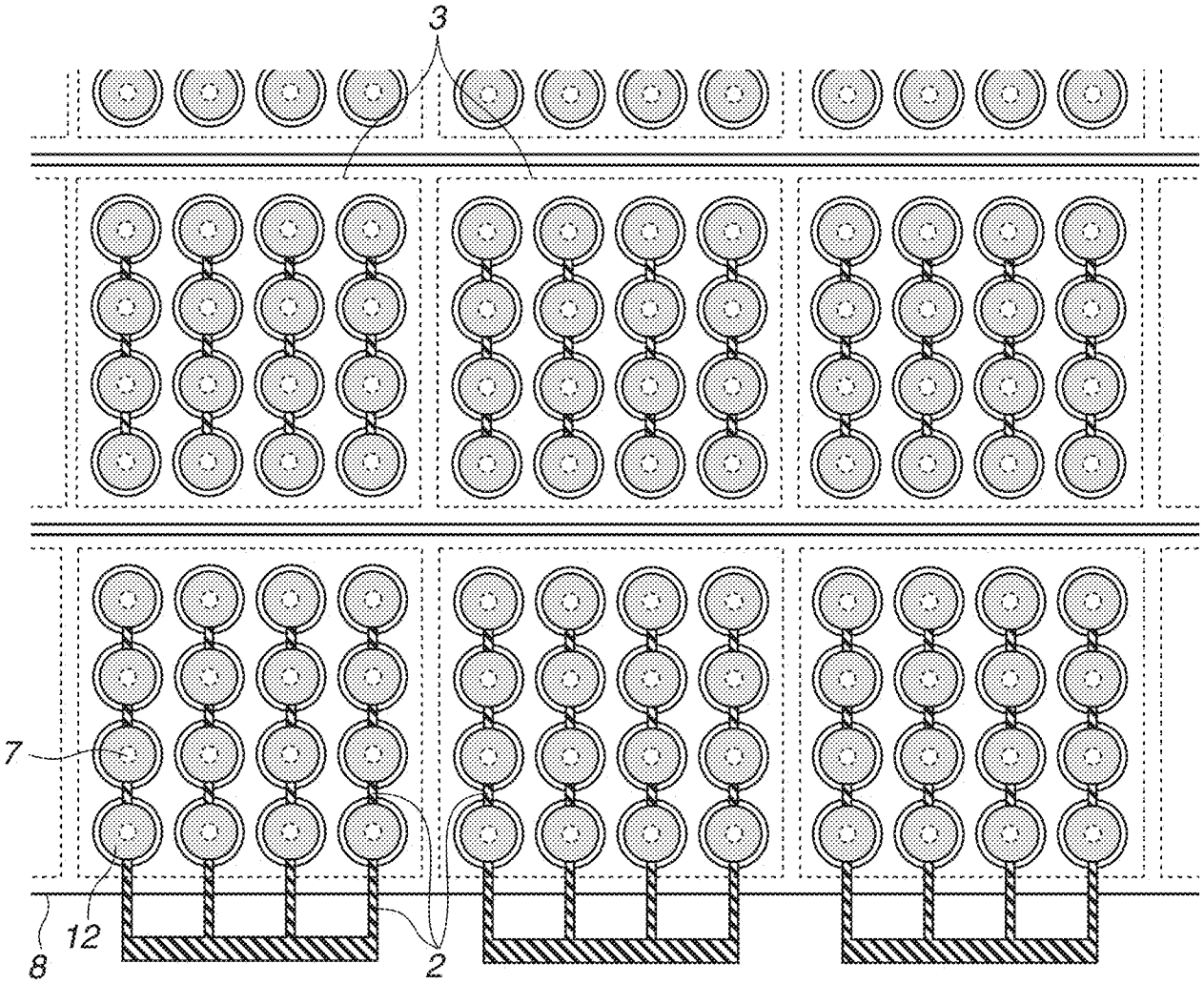
FIG. 3 is a diagram illustrating an array element using the CMUT according to an exemplary embodiments.

In addition, according to the present exemplary embodiment, the CMUT is used as an array element. The array element includes a plurality of the elements 3 arranged one-dimensionally as illustrated in FIG. 3 or two-dimensionally (not illustrated), and an entire size of the arranged plurality of elements 3 is several centimeters. Therefore, variation in performance due to structural distribution occurs among the array elements. In other words, the vibrating membrane 6 does not come into contact with the surface at the bottom of the air gap 10 in one element but comes into contact with the surface at the bottom of the air gap 10 in another element even if the same AC voltage is applied. Accordingly, variation in sensitivity among elements becomes larger.

Figure 14A:
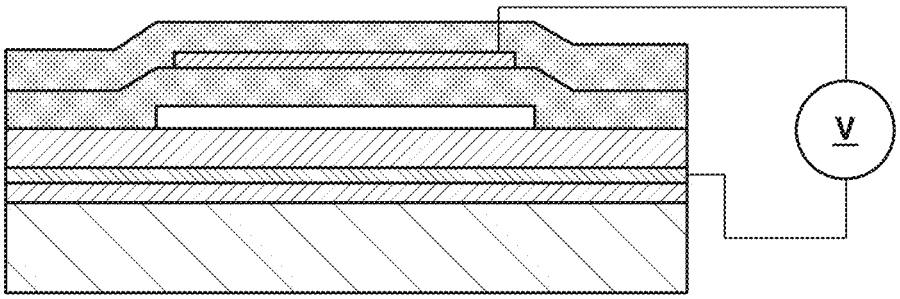
FIGS. 14A and 14B are diagrams illustrating configurations of a conventional CMUT.
Figure 14B:
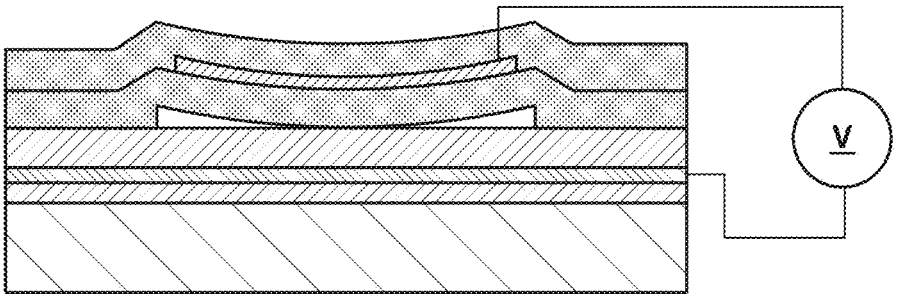

The concave portion 7 according to the present exemplary embodiment has an effect of reducing electric charge from being taken into the insulating film by limiting a contact area in a case where the vibrating membrane 6 is to come into contact with the surface at the bottom of the air gap 10 (a surface at which the first insulating film 9 faces the air gap 10). FIGS. 14A and 14B are diagrams for comparison. FIGS. 14A and 14B illustrate cross-sectional configurations of a cell in a conventional CMUT, and an insulating film does not have a concave portion. Obviously, the contact area between the vibrating membrane 6 and the surface at the bottom of the air gap 10 is reduced in comparison with the configuration according to the present exemplary embodiment having the concave portion 7. A charge amount passing through the insulating film is relative to a contact area. Therefore, reduction of the contact area has an effect of reducing a charge amount in the insulating film. Consequently, a magnitude of the sensitivity change can be largely reduced with respect to a use time. In addition, the vibrating membrane 6 is insulated by the concave portion 7 and is not restricted in the amplitude thereof. In other words, according to the present exemplary embodiment, the long-term reliability performance can be improved while maintaining a large amplitude of the vibrating membrane 6 and the change due to the variation in performance of the elements 3 can be reduced.

It is desirable that a position at which the concave portion is formed according to the present exemplary embodiment is a position at which displacement of the vibrating membrane 6 is the largest when viewed from the direction perpendicular to the surface facing the air gap 10. The position at which displacement of the vibrating membrane is the largest may include at least the relevant position and may include a region including surroundings of the relevant position. Further, the position at which the concave portion is formed according to the present exemplary embodiment can be appropriately changed depending on a shape of the vibrating membrane 6 viewed from the direction perpendicular to the surface facing the air gap 10. For example, in a case where the shape of the vibrating membrane 6 is circular, the concave portion can be formed in a region including the center. In a case where the shape of the vibrating membrane 6 is rectangular, the concave portion can be formed in a region including an intersection of two diagonal lines of the rectangular vibrating membrane 6.

According to the present exemplary embodiment, the concave portion represents a concave which is formed on a part of the membrane. More specifically, a concave is not formed by providing a membrane having a uniform thickness on a base substrate having a concave portion.

Figure 2:
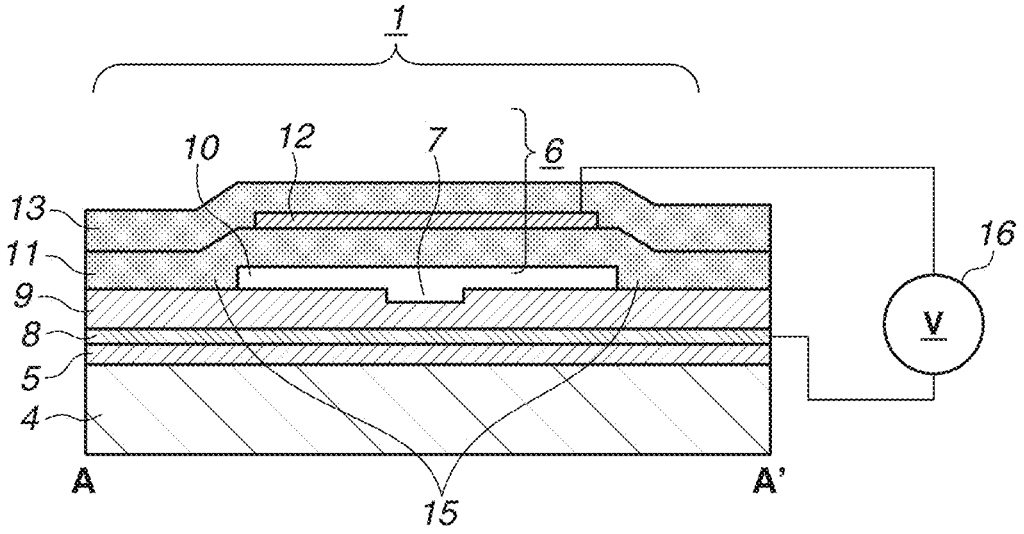
FIG. 2 is a cross-sectional view illustrating the CMUT according to an exemplary embodiments.

In FIG. 2, the first insulating film 9 includes the concave portion. This configuration reduces the contact area between the first insulating film 9 and the second insulating film 11 by the concave portion 7 in a case where the vibrating membrane 6 largely vibrates and comes into contact with the surface at the bottom surface of the air gap 10 and thus has an effect similar to that of the configuration illustrated in FIGS. 1A to 1C.

Figure 4:
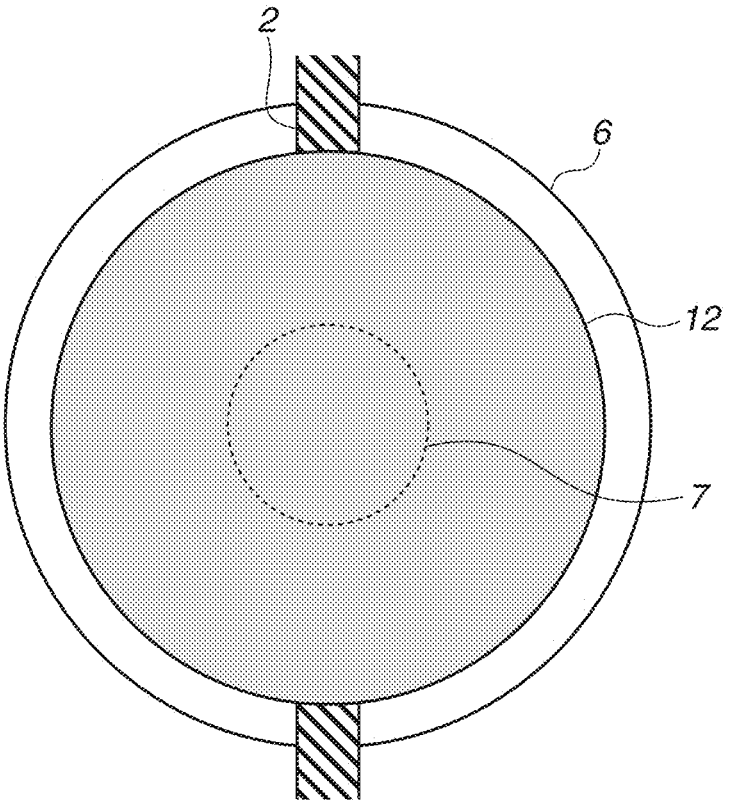
FIG. 4 is a top view illustrating the CMUT according to an exemplary embodiments.
Figure 5:
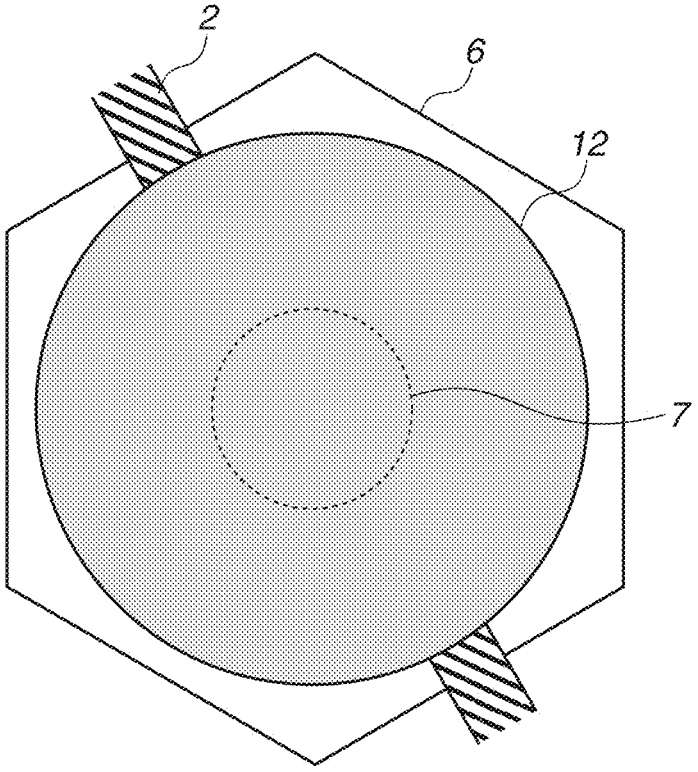
FIG. 5 is a top view illustrating the CMUT according to an exemplary embodiments.
Figure 6A:
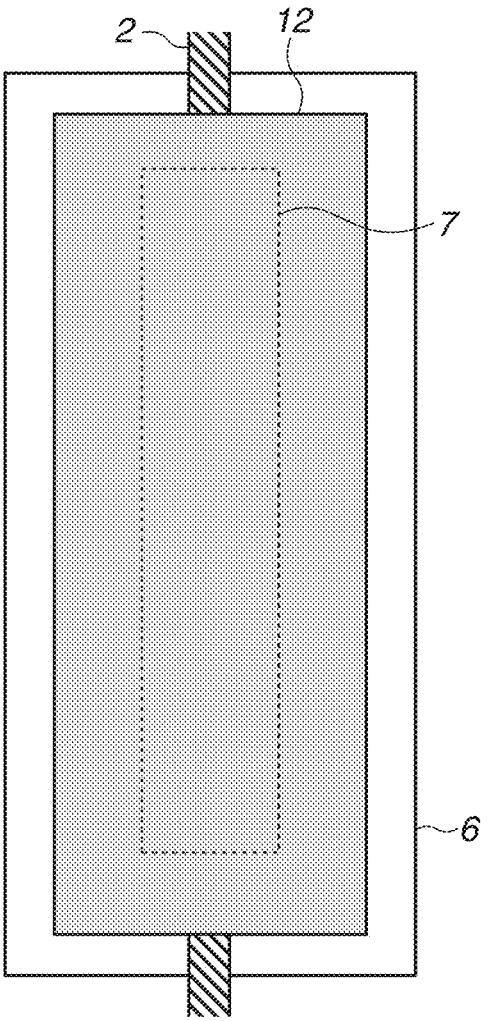
FIGS. 6A and 6B are top views illustrating the CMUT according to an exemplary embodiments.
Figure 6B:
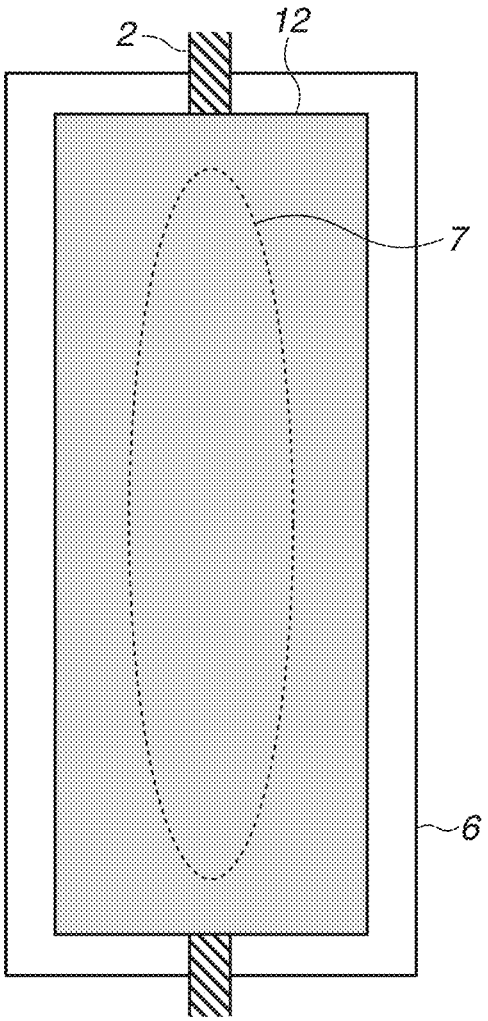

A relationship between a vibrating membrane shape and a concave portion shape is described. The effect can be obtained by coinciding a position of the concave portion 7 with a maximum displacement position of the vibrating membrane 6. A vibration shape depends on the vibrating membrane shape, and thus the concave portion shape differs accordingly. In a case where the vibrating membrane shape is circular or a regular polygon as illustrated in FIGS. 4 and 5, it is desirable that the concave portion 7 is formed in a circular shape at the center of the vibrating membrane. Further, in a case where the vibrating membrane shape is rectangular having a large aspect ratio as illustrated in FIGS. 6A and 6B, it is desirable that the concave portion 7 has a rectangular shape or a long elliptical shape. The concave portion 7 has a depth larger than irregularity and roughness on a surface of the air gap 10, i.e., a distinct level difference is distinctly formed. Thus, the depth is desirably about 20 nanometers or more. Regarding a maximum value of the depth of the concave portion 7, the deeper the concave portion 7, the higher a risk to the insulation property of the insulating film becomes, and in a case where the concave portion is formed on the vibrating membrane, a mechanical characteristic of the vibrating membrane is also affected. Thus, it is desirable that the depth of the concave portion 7 is up to about 20 percent of a thickness of the insulating film on which the concave portion 7 exists. For example, in the case of FIG. 1B, if a thickness of the second insulating film 11 is 400 nanometers, the depth of the concave portion 7 is desirably about from 20 to 80 nanometers. The concave portion 7 may have a width or a diameter with which the maximum displacement portion of the vibrating membrane 6 does not directly come into contact with the surface at the bottom of the air gap 10 in a case where the vibrating membrane 6 comes into contact with the surface at the bottom of the air gap 10. Therefore, if a diameter or a short side width of the vibrating membrane 6 is a representative length, the diameter or the width of the concave portion 7 is desirably about 10 to 50 percent of the representative length. For example, in a case of a circular vibrating membrane having a diameter of 30 micrometers, the diameter of the concave portion is 3 to 15 micrometers.

Figure 7A:
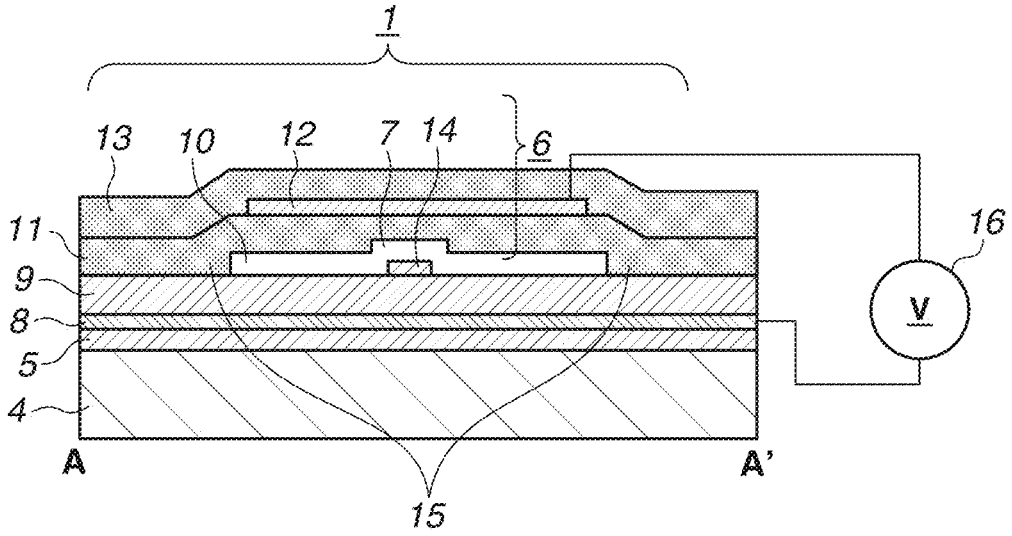
FIGS. 7A and 7B are diagrams illustrating a CMUT according to a third exemplary embodiment.
Figure 7B:
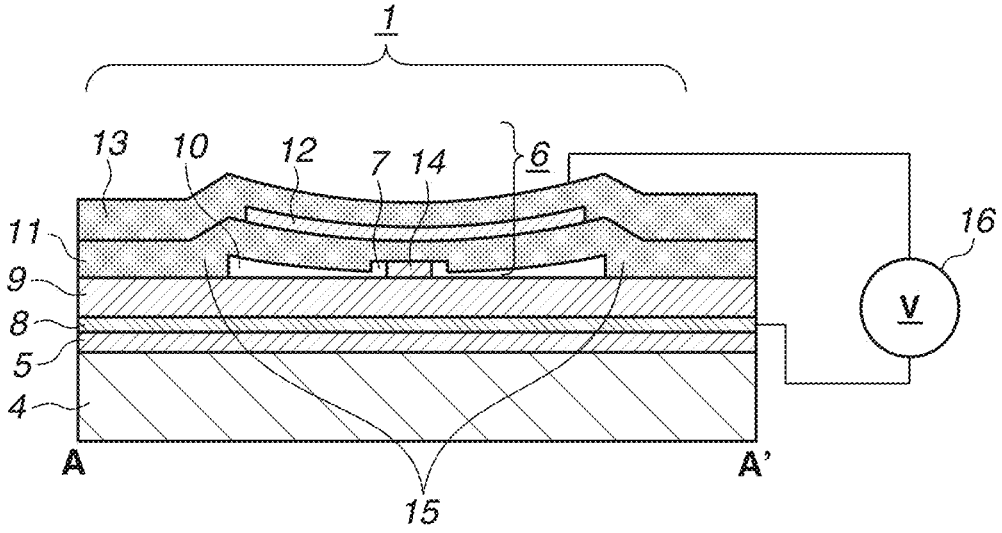
Figure 8:
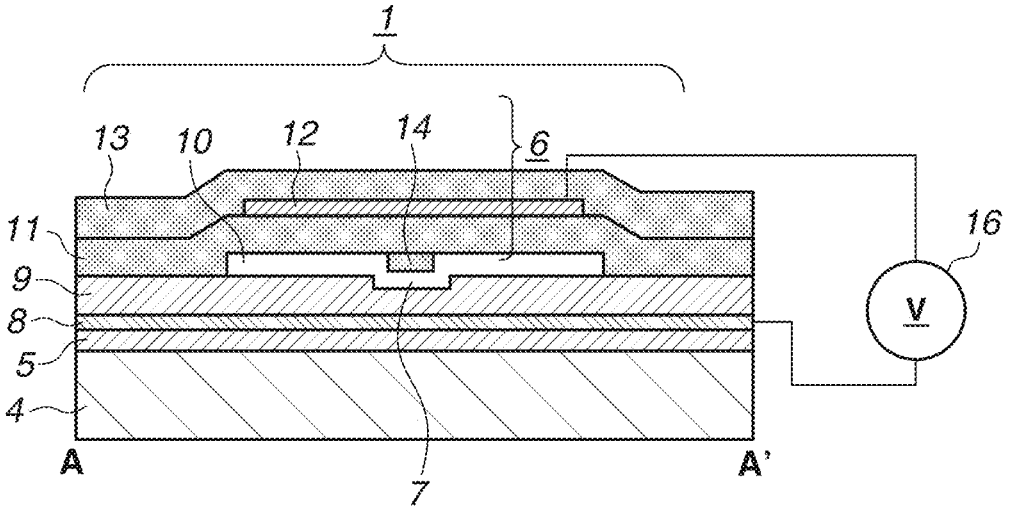
FIG. 8 is a diagram illustrating a CMUT according to a fourth exemplary embodiment.

Further, in a case where a protrusion 14 is formed on the first insulating film 9 as illustrated in FIGS. 7A and 7B, or in a case where the protrusion 14 is formed on the vibrating membrane 6 as illustrated in FIG. 8, the concave portion 7 is formed on the same position as the protrusion 14, and thus only the protrusion 14 comes into contact with a bottom surface of the concave portion 7. In this configuration, a height of the protrusion 14 is set larger than the depth of the concave portion 7. Consequently, the amplitude of the vibrating membrane 6 is not reduced by the protrusion 14, and the long-term reliability can be improved.

Figure 9A:
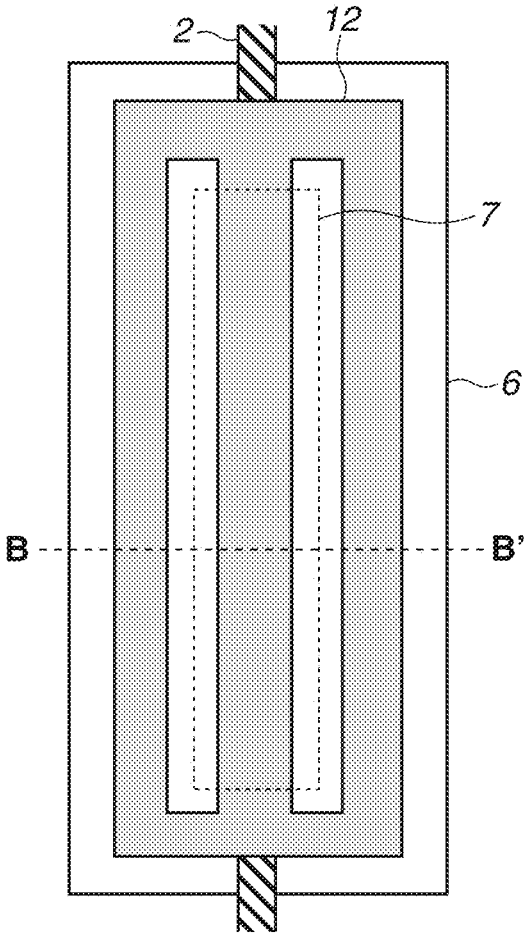
FIGS. 9A and 9B are diagrams illustrating a CMUT according to a fifth exemplary embodiment.
Figure 9B:
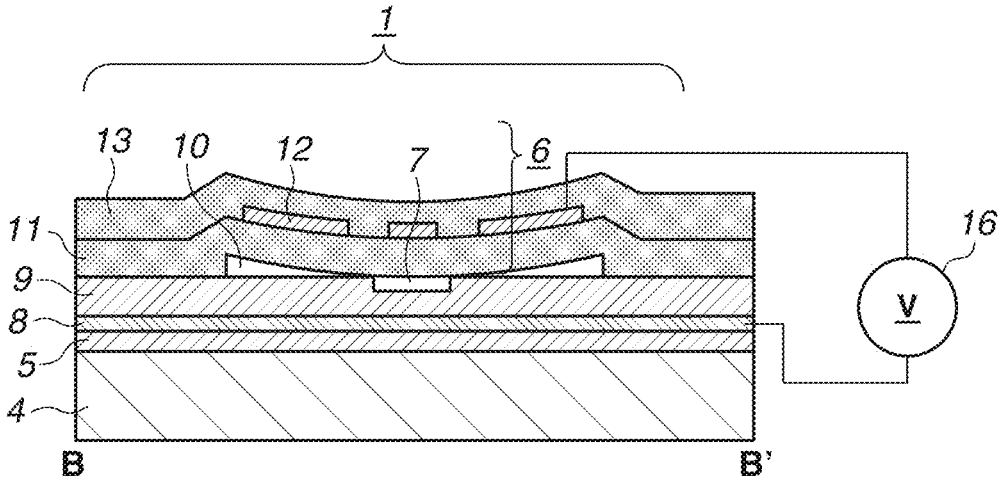
Figure 10A:
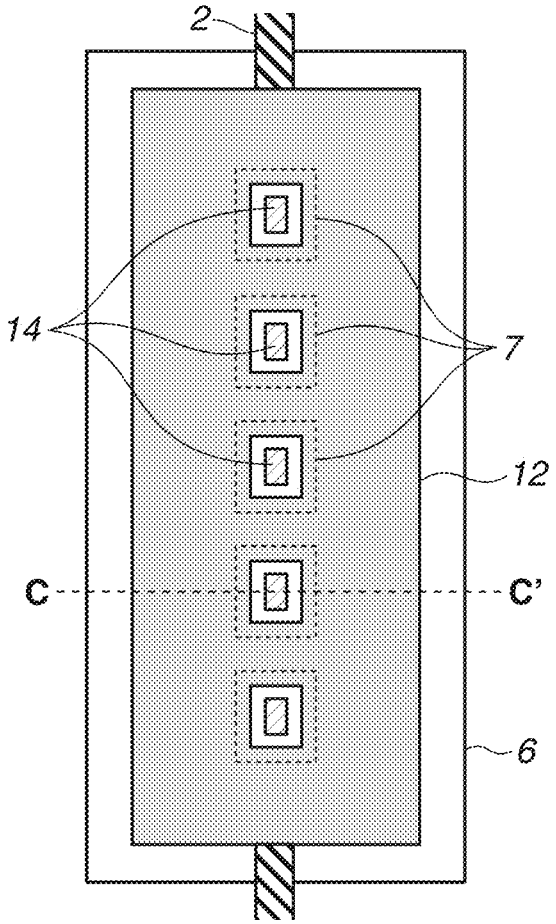
FIGS. 10A and 10B are diagrams illustrating a CMUT according to a sixth exemplary embodiment.
Figure 10B:
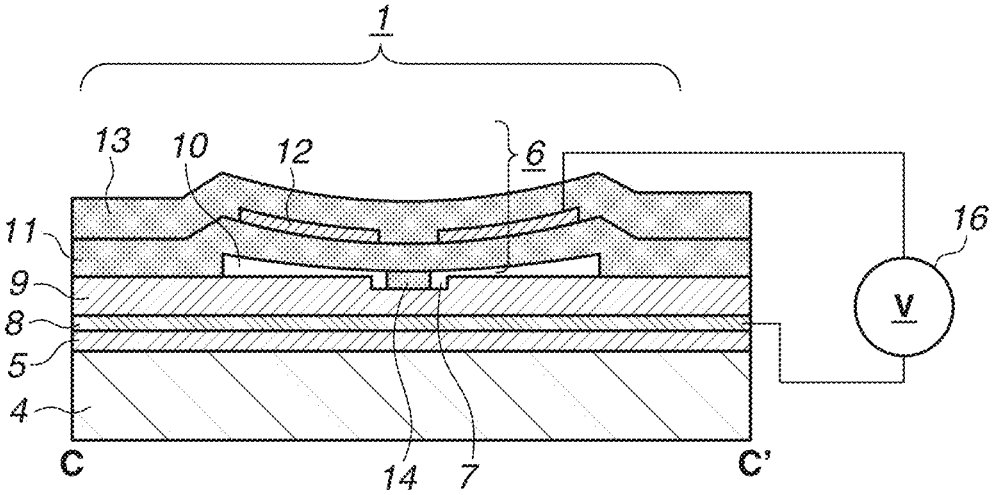

In addition, in the configuration according to the present exemplary embodiment, either or both of the first electrode 8 and the second electrode 12 are not formed immediately above or immediately below a portion at which the first insulating film 9 comes into contact with the vibrating membrane 6 as illustrated in FIGS. 9A and 9B. This configuration can further reduce an electric field strength applied to the first insulating film 9 and the second insulating film 11 coming into contact with each other. In a case where the protrusion 14 is formed as illustrated in FIGS. 10A and 10B, a portion at which the vibrating membrane 6 comes into contact with the surface at the bottom of the air gap 10 is restricted by the protrusion 14. In this case, the electric field strength applied to the first insulating film 9 and the second insulating film 11 can be reduced by separating either or both of the first electrode 8 and the second electrode 12 from immediately below or immediately above the protrusion 14.

In each configuration, concentration of the electric field is reduced by forming the concave portion only on the insulating film and flattening the electrodes. This configuration has an effect of reducing the electric field strength generated in a case where the vibrating membrane 6 comes into contact with the surface at the bottom of the air gap 10 and further reducing a charge transfer amount.

It is known that a charge amount passing through the insulating film is not relative to the electric field strength applied to the insulating film, and a conduction mechanism is changed in a case where the electric field strength exceeds a certain degree. For example, a Fowler-Nordheim conduction mechanism with a partial tunneling effect is known in a silicon oxide film, and a Poole-Frenkel conduction mechanism via a trapping level is known in a silicon nitride film. If the electric field strength causing these conduction mechanisms is applied, a large amount of electric charge outflows and is trapped in the insulating film, and this event is a factor of charging. Therefore, it is necessary to determine the configuration of the first insulating film 9, the thickness of the second insulating film 11, the first electrode 8, and the second electrode 12 in such a manner that a contact portion between the vibrating membrane 6 and the surface at the bottom of the air gap 10 has the electric field strength for not causing large charge transfer. In a case where a silicon oxide film and a silicon nitride film is used, a maximum electric field strength is respectively set to 4 MV/cm or less and 3 MV/cm or less, and accordingly a large amount of charge transfer can be reduced.

By the configuration of the element according to the present exemplary embodiment, charge transfer generated between the electrodes in transmission is reduced and the long-term reliability regarding the CMUT is improved. In the CMUT, a vibration amplitude of the vibrating membrane is restricted to a region smaller than a height of the air gap to prevent a change in the sensitivity caused by occurrence of charging due to contact of the vibrating membrane. However, in order to obtain an echo signal having a high signal-to-noise (S/N) ratio or to perform information extraction based on a nonlinear effect of ultrasonic wave propagation, a large sound pressure output is required. In a case where an element having a large air gap height is designed, it is possible to increase the transmission sound pressure, but application of a large voltage is required at the same time. The concave portion structure of the insulating film according to the present exemplary embodiment can increase the amplitude of the vibrating membrane by making the utmost effective use of the air gap height. If the vibrating membrane comes into contact with the surface at the bottom of the air gap, charge transfer in the insulating film is minimized, and the long-term reliability is improved since the sensitivity change in continuous use is reduced. The present exemplary embodiment can realize the CMUT having a high transmission sound pressure and a high receiving sensitivity in restrictions such as safety, an electrical circuit, and an applied voltage by a voltage applying unit and can realize an ultrasonic probe equipped with the CMUT.

(Ultrasonic Probe)

An ultrasonic probe according to the exemplary embodiment includes a reception unit which receives an ultrasonic wave irradiated on an object and outputs a reception signal and an information obtainment unit which obtains information of the object based on at least the obtained reception signal. The reception unit includes the CMUT according to the above-described present exemplary embodiment.

(Example of Method for Manufacturing CMUT)

An example of a method for manufacturing the CMUT according to the exemplary embodiment includes at least each of the following processes.

(1) A process for forming a first insulating film on a first electrode.

(2) A process for forming a sacrificial layer on the first insulating film.

(3) A process for forming a second insulating film on the sacrificial layer.

(4) A process for forming a second electrode on the second insulating film.

(5) A process for forming an etching hole by removing a part of the second insulating film and exposing a part of the sacrificial layer.

(6) A process for forming an air gap by removing the sacrificial layer.

The sacrificial layer is formed in such a manner that a concave portion is formed on a surface of the second insulating film facing the air gap by removing the sacrificial layer. In other words, the sacrificial layer is formed to form a convex portion shape, and thus the air gap including the concave portion on the second insulating film can be formed by removing the sacrificial layer.

The present method may include each of the following processes as a method for forming the air gap having the concave portion.

First, the sacrificial layer is formed to include a first sacrificial layer and a second sacrificial layer, and the second insulating film is formed to include a first layer and a second layer. The process for forming the sacrificial layer includes a process for forming the first sacrificial layer and a process for forming the second sacrificial layer on the first sacrificial layer to cover the first sacrificial layer. Further, the process for forming the second insulating film includes a process for removing a part of the first layer of the second insulating film in such a manner that the first sacrificial layer is exposed after forming the first layer of the second insulating film and a process for forming the second layer of the second insulating film on the exposed first sacrificial layer.

(Other Example of Method for Manufacturing CMUT)

Another example of a method for manufacturing the CMUT according to the exemplary embodiment includes at least each of the following processes.

(1) A process for forming a first insulating film on a first electrode.

(2) A process for forming a sacrificial layer on the first insulating film.

(3) A process for forming a second insulating film on the sacrificial layer.

(4) A process for forming a second electrode on the second insulating film.

(5) A process for forming an etching hole by removing the second insulating film and exposing a part of the sacrificial layer.

(6) A process for forming an air gap by removing the sacrificial layer.

The sacrificial layer is formed in such a manner that by removing the sacrificial layer, a concave portion is formed on a surface of the first insulating film facing the air gap. In other words, the sacrificial layer is formed to form a convex portion shape, and thus the air gap including the concave portion on the second insulating film can be formed by removing the sacrificial layer.

The present method may include each of the following processes as a method for forming the air gap having the concave portion.

First, the first insulating film is formed to include a first layer and a second layer, and the sacrificial layer is formed to include the first sacrificial layer and the second sacrificial layer. Further, a process for forming the first layer of the first insulating film, a process for forming the first sacrificial layer on the first layer of the first insulating film, and a process for forming the second layer of the first insulating film on the first sacrificial layer to cover the first sacrificial layer are included. Furthermore, a process for removing a part of the second layer of the first insulating film to expose the first sacrificial layer and a process for forming the second sacrificial layer on the exposed first sacrificial layer are included.

The first insulating film and the second insulating film may include silicon oxide and silicon nitride, respectively, and both of the first insulating film and the second insulating film may include silicon oxide.

A process for forming the third insulating film on the second electrode may be further included. A process for forming a fourth insulating film for sealing the etching hole on the third insulating film may be further included.

The present exemplary embodiment is described in detail below with more specific exemplary embodiments. Materials and parameters described in each of the exemplary embodiments are merely examples and do not restrict the disclosure.

A CMUT according to a first exemplary embodiment is described with reference to FIGS. 1A to 1C. FIG. 1A is a top view of the CMUT according to the present exemplary embodiment, and the element 3 is configured as a one-dimensional array.

A cross-sectional structure of the cell 1 is described. A silicon oxide film having a thickness of one micrometer is formed as the insulating layer 5 on a silicon single crystal substrate 4. The first electrode 8 is a laminated film including 100 nanometers thick tungsten and 10 nanometers thick titanium, and a first insulating film 9 is silicon oxide having a thickness of 400 nanometers. The height of the air gap 10 excluding the concave portion 7 is 300 nanometers, and the air gap is depressurized to 200 pascals and sealed. The second insulating film 11 over the air gap 10 is a silicon nitride film having a thickness of 600 nanometers. The second electrode 12 is made of an aluminum-neodymium alloy having a thickness of 100 nanometers. The vibrating membrane of the cell 1 has a diameter of 30 micrometers, the second electrode 12 has a diameter of 28 micrometers, and the wire 2 has a width of 4 micrometers. The third insulating film 13 is a silicon nitride film having a thickness of 400 nanometers. The vibrating membrane 6 includes the second insulating film 11, the second electrode 12, and the third insulating film 13. The second insulating film 11 and the third insulating film 13 have tensile stress and thus stably form the vibrating membrane 6. According to the present exemplary embodiment, the silicon nitride films as the second insulating film 11 and the third insulating film 13 have stress of 100 megapascals.

The concave portion 7 is formed on a position of the maximum displacement of the vibrating membrane 6 when viewed from an upper surface of the vibrating membrane 6. A size the concave portion 7 is relatively determined based on a size of the vibrating membrane 6. According to the present exemplary embodiment, the vibrating membrane 6 is circular, and thus the concave portion 7 is formed on a center portion of the air gap 10. The concave portion 7 has a depth of about 20 nanometers and a diameter of about 5 micrometers.

A plurality of the concave portions may be formed. In a case where the plurality of the concave portions is formed, each of the concave portions may have the same diameter or different diameters. Further, in a case where the plurality of the concave portions is formed, a plurality of protrusion portions described below can be formed.

A voltage applying unit 16 applies a DC voltage between the first electrode 8 and the second electrode 12, and thus the CMUT can transmit and receive an ultrasonic wave by performing electromechanical conversion. In a case where an ultrasonic wave is transmitted, the voltage applying unit 16 applies an AC voltage in addition to the DC voltage. A driving condition of the CMUT is determined by a pull-in voltage of the cell 1. "Pull-in" is an event in which, in a case where a DC voltage is applied between the first electrode 8 and the second electrode 12, balance between a restoration force by rigidity of the vibrating membrane and an electrostatic force is lost, and the vibrating membrane comes into contact with the surface at the bottom of the air gap 10, and a voltage causing pill-in is referred to as a pull-in voltage. The pull-in voltage of the cell 1 according to the present exemplary embodiment is 300 volts (V), and driving conditions are the DC voltage of 200 V and a maximum amplitude value of the AC voltage of 100 V.

The CMUT is primarily used to receive an echo of a transmitted ultrasonic wave by itself and obtain various types of information pieces such as a distance, a direction, a type of an object, a characteristic, and a velocity. In order to obtain information with high precision, it is necessary to increase a sound pressure to be transmitted as much as possible. Therefore, in the case of the CMUT, a maximum sound pressure can be obtained by vibrating the vibrating membrane 6 to the same extent as the height of the air gap 10. On this occasion, the vibrating membrane 6 comes into contact with the surface at the bottom of the air gap 10, electric charge enters into the first insulating film 9 and the second insulating film 11, and charging occurs. According to the present exemplary embodiment, a charge amount can be reduced by reducing the contact area by the concave portion 7, and the long-term reliability of the CMUT can be improved.

A CMUT according to a second exemplary embodiment is described with reference to FIG. 2. The configurations of the elements in the CMUT are almost similar to those of the first exemplary embodiment.

First, a cross-sectional structure of the cell 1 is described. On the silicon single crystal substrate 4, a silicon oxide film having a thickness of one micrometer as the insulating layer 5 is formed. On the insulating layer 5, a laminated film having a thickness of 500 nanometers as the first electrode 8 including titanium nitride, aluminum alloy, and titanium nitride is formed. On the first electrode 8, silicon oxide having a thickness of 400 nanometers as the first insulating film 9 is formed. The height of the air gap 10 excluding the concave portion 7 is 300 nanometers, and the air gap is depressurized to 200 pascals and sealed. The second insulating film 11 over the air gap 10 is a silicon oxide film having a thickness of 700 nanometers. The second electrode 12 is a 500-nanometer thick laminated layer of titanium nitride, aluminum alloy, and titanium nitride. The vibrating membrane of the cell 1 has a diameter of 30 micrometers, the second electrode 12 has a diameter of 28 micrometers, and the wire 2 has a width of 4 micrometers. The third insulating film 13 is a silicon nitride film having a thickness of 600 nanometers. The vibrating membrane 6 includes the second insulating film 11, the second electrode 12, and the third insulating film 13. The second insulating film 11 and the third insulating film 13 have tensile stress and thus stably form the vibrating membrane 6. According to the present exemplary embodiment, the silicon nitride film as the third insulating film 13 has stress of 100 megapascals.

The concave portion 7 is formed on a position of the maximum displacement of the vibrating membrane 6 when viewed from a primary vibration direction of the vibrating membrane 6. The size the concave portion 7 is relatively determined based on the size of the vibrating membrane 6. According to the present exemplary embodiment, the vibrating membrane 6 is circular, and thus the concave portion 7 is formed on the center portion of the air gap 10. The concave portion 7 has a depth of about 20 nanometers and a diameter of about 5 micrometers. The pull-in voltage of the cell 1 according to the present exemplary embodiment is 300 V, and the driving conditions are the DC voltage of 200 V and the maximum amplitude value of the AC voltage of 100 V.

In the CMUT according to the present exemplary embodiment, the contact area is largely reduced by the effect of the concave portion 7 formed on the first insulating film 9 if the vibrating membrane 6 comes into contact with the surface at the bottom of the air gap 10. Thus, charge amounts in the first insulating film 9 and the second insulating film 11 can be reduced, and the long-term reliability of the CMUT can be improved as with the first exemplary embodiment. In addition, since the first insulating film 9 has the concave portion 7, and the vibrating membrane 6 has a simple shape, uniformity of characteristics is improved among elements.

A CMUT according to a third exemplary embodiment is described with reference to FIGS. 7A and 7B. The configurations and materials of the elements in the CMUT are similar to those of the first exemplary embodiment. FIG. 7A is a cross-sectional structure view of the present exemplary embodiment, and FIG. 7B illustrates deformation of the structure in a case where the vibrating membrane 6 is displaced.

The concave portion 7 is formed on a position of the maximum displacement of the vibrating membrane 6 when viewed from the primary vibration direction of the vibrating membrane 6. The size the concave portion 7 is relatively determined based on the size of the vibrating membrane 6. According to the present exemplary embodiment, the vibrating membrane 6 is circular, and thus the concave portion 7 is formed on the center portion of the air gap 10. The concave portion 7 has a depth of about 20 nanometers and a diameter of about 5 micrometers.

Whereas, the protrusion 14 on the surface at the bottom of the air gap 10 is formed on a position facing the concave portion 7 via the air gap 10. The protrusion 14 has a height larger than the depth of the concave portion 7 and a width smaller than the width of the concave portion 7. According to the present exemplary embodiment, the protrusion 14 has a height of about 30 nanometers and a width of about 3 micrometers.

The pull-in voltage of the cell 1 according to the present exemplary embodiment is 300 V, and the driving conditions are the DC voltage of 200 V and the maximum amplitude value of the AC voltage of 100 V.

As illustrated in FIG. 7B, in the CMUT according to the present exemplary embodiment, the contact area is largely reduced by the effects of the protrusion 14 formed on the first insulating film 9 and the concave portion 7 formed on the second insulating film 11 if the vibrating membrane 6 comes into contact with the surface at the bottom of the air gap 10. While the contact area between the vibrating membrane 6 and the surface at the bottom of the air gap 10 is similar to the contact area of the case only having the protrusion 14, a large magnitude of the amplitude of the vibrating membrane 6 can be secured by the concave portion 7.

Further, as illustrated in FIG. 7B, the protrusion 14 may have a curved surface on a contact portion with the vibrating membrane 6. In this case, the contact area becomes smaller, and a charge amount can be suppressed.

Thus, the charge amounts in the first insulating film 9 and the second insulating film 11 can be reduced, and the long-term reliability of the CMUT can be improved.

An example of a CMUT according to a fourth exemplary embodiment is described with reference to FIG. 8. The configurations of the elements in the CMUT are similar to those of the first exemplary embodiment. Further, the cross-sectional structure and the materials of the cell are almost similar to those of the first and the second exemplary embodiments.

The concave portion 7 is formed on a position of the maximum displacement of the vibrating membrane 6 when viewed from the primary vibration direction of the vibrating membrane 6. The size the concave portion 7 is relatively determined based on the size of the vibrating membrane 6. According to the present exemplary embodiment, the vibrating membrane 6 is circular, and thus the concave portion 7 is formed on the center portion of the air gap 10. The concave portion 7 has a depth of about 20 nanometers and a diameter of about 5 micrometers.

Whereas, the protrusion 14 on a lower surface of the vibrating membrane 6 is formed on a position facing the concave portion 7 formed on the first insulating film 9 via the air gap 10. The protrusion 14 has a height larger than the depth of the concave portion 7 and a width smaller than the width of the concave portion 7. According to the present exemplary embodiment, the protrusion 14 has a height of about 30 nanometers and a width of about 3 micrometers.

The pull-in voltage of the cell 1 according to the present exemplary embodiment is 300 V, and the driving conditions are the DC voltage of 200 V and the maximum amplitude value of the AC voltage of 100 V.

In the CMUT according to the present exemplary embodiment, the contact area is largely reduced since the contact area is limited to a leading edge of the protrusion 14 by the effects of the concave portion 7 formed on the first insulating film 9 and the protrusion 14 formed on the second insulating film 11 if the vibrating membrane 6 comes into contact with the surface at the bottom of the air gap 10. While the contact area between the vibrating membrane 6 and the surface at the bottom of the air gap 10 is similar to the contact area of the case only having the protrusion 14, the large magnitude of the amplitude of the vibrating membrane 6 can be secured by the concave portion 7.

Further, the protrusion 14 may have a curved surface on a contact portion with the first insulating film 9. In this case, the contact area becomes smaller, and a charge amount can be reduced.

Thus, the charge amounts in the first insulating film 9 and the second insulating film 11 can be reduced, and the long-term reliability of the CMUT can be improved.

An example of a CMUT according to a fifth exemplary embodiment is described with reference to FIGS. 9A and 9B. The configurations of the elements, the membrane, and the films in the CMUT are similar to those of the first exemplary embodiment. However, the cell has a rectangular shape. FIG. 9A is a top view of the cell, and FIG. 9B is a cross-sectional view of the cell in a case where the vibrating membrane 6 is in a deformed shape by being applied with a voltage.

The vibrating membrane 6 of the cell 1 has a length in a short side direction of 24 micrometers and a length in a long side direction of 240 micrometers, the second electrode 12 has a width of 22 micrometers, and the wire 2 has a width of 4 micrometers. The third insulating film 13 is a silicon nitride film having a thickness of 400 nanometers. The pull-in voltage of the cell 1 according to the present exemplary embodiment is 300 V, and the driving conditions are the DC voltage of 200 V and the maximum amplitude value of the AC voltage of 100 V.

The concave portion 7 is formed on a position of the maximum displacement of the vibrating membrane 6 when viewed from the primary vibration direction of the vibrating membrane 6. The size the concave portion 7 is relatively determined based on the size of the vibrating membrane 6. According to the present exemplary embodiment, the vibrating membrane 6 is rectangular, and the concave portion 7 is formed on the center position of the air gap 10 in the short side direction. The concave portion 7 also has a rectangular shape since displacement of the vibrating membrane 6 has uniformity in the long side direction. The concave portion 7 has a depth of about 20 nanometers, a length in the short side direction of about 5 micrometers, and a length in the long side direction of 230 micrometers.

In the CMUT according to the present exemplary embodiment, the contact area is largely reduced by the effects of the concave portion 7 formed on the second insulating film 11 even if the vibrating membrane 6 comes into contact with the surface at the bottom of the air gap 10. Further, even though the vibrating membrane 6 comes into contact with the first insulating film 9 at an edge portion of the concave portion 7 in the short side direction, the second electrode 12 is formed not immediately above the concave portion 7. Therefore a distance between the first electrode 8 and the second electrode 12 is increased, and the electric field strength applied to the inside of the first insulating film 9 and the second insulating film 11 is further reduced. Thus, the charge amounts in the first insulating film 9 and the second insulating film 11 can be reduced, and the long-term reliability of the capacitive ultrasonic transducer can be improved.

An example of a capacitive ultrasonic transducer according to a sixth exemplary embodiment is described with reference to FIGS. 10A and 10B. The configurations of the elements in the capacitive ultrasonic transducer are similar to those of the first exemplary embodiment, and the configurations of the membrane and the films and the air gap height are almost similar to those of the fifth exemplary embodiment. FIG. 10A is a top view of the cell, and FIG. 10B is a cross-sectional view of the cell in a case where the vibrating membrane 6 is in a deformed shape by being applied with a voltage.

The concave portion 7 is formed on a position of the maximum displacement of the vibrating membrane 6 when viewed from the primary vibration direction of the vibrating membrane 6. The size the concave portion 7 is relatively determined based on the size of the vibrating membrane 6. According to the present exemplary embodiment, the vibrating membrane 6 is rectangular, and the concave portion 7 is formed on the center portion of the air gap 10 in the short side direction. Since the amplitude of the vibrating membrane 6 is uniform in the long side direction, the concave portions 7 and the protrusions 14 may be formed on several positions as illustrates in FIG. 10A. According to the present exemplary embodiment, the concave portions 7 and the protrusions 14 are formed on five positions. The concave portion 7 has a depth of about 20 nanometers and a width of about 5 micrometers.

The protrusion 14 on the surface at the bottom of the vibrating membrane 6 is formed on a position facing the concave portion 7 via the air gap 10. The protrusion 14 has a height larger than the depth of the concave portion 7 and has a width smaller than the width of the concave portion 7. According to the present exemplary embodiment, the protrusion 14 has a height of about 30 nanometers and a width of about 3 micrometers.

The pull-in voltage of the cell 1 according to the present exemplary embodiment is 300 V, and the driving conditions are the DC voltage of 200 V and the maximum amplitude value of the AC voltage of 100 V.

In the capacitive ultrasonic transducer according to the present exemplary embodiment, the contact area is largely reduced since the contact area is limited to the leading edge of the protrusion 14 by the effects of the concave portion 7 formed on the first insulating film 9 and the protrusion 14 formed on the second insulating film 11 if the vibrating membrane 6 comes into contact with the surface at the bottom of the air gap 10. While the contact area between the vibrating membrane 6 and the surface at the bottom of the air gap 10 is similar to the contact area of the case only having the protrusion 14, the large magnitude of the amplitude of the vibrating membrane 6 can be secured by the concave portion 7. Further, even though the vibrating membrane 6 comes into contact at the protrusion 14 with a bottom of the concave portion 7, the second electrode 12 is formed not immediately above the concave portion 7. Therefore, the distance between the first electrode 8 and the second electrode 12 is increased, and the electric field strength applied to the inside of the first insulating film 9 and the second insulating film 11 is further reduced. Thus, the charge amounts in the first insulating film 9 and the second insulating film 11 can be reduced, and the long-term reliability of the capacitive ultrasonic transducer can be improved.

An example of a method for manufacturing a capacitive ultrasonic transducer according to a seventh exemplary embodiment is described with reference to FIGS. 11A to 11I. The capacitive ultrasonic transducer manufactured according to the present exemplary embodiments corresponds to the one illustrated in FIGS. 1A to 1C.

Figure 11A:
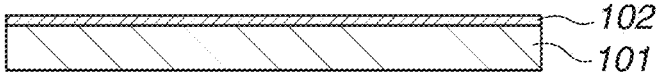
FIGS. 11A to 11I are diagrams illustrating an example of a method for manufacturing a CMUT according to a seventh exemplary embodiment.

In FIG. 11A, a silicon single crystal substrate 101 is subjected to thermal oxidation to form a silicon oxide film 102 having a thickness of one micrometer. In the thermal oxidation process, a substrate surface is entirely oxidized, but a rear surface side of which description is omitted here is not illustrated in FIG. 11A.

Figure 11B:
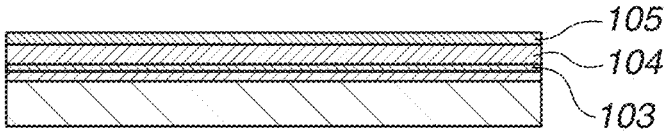

Next, as illustrated in FIG. 11B, a tungsten film having a thickness of 100 nanometers and a titanium film having a thickness of 10 nanometers are sequentially formed by sputtering, and a first electrode 103 is formed by performing photolithography and patterning processes. The first electrode 103 is uniform in FIG. 11B but is actually subjected to pattern forming. Subsequently, a first insulating film 104 is formed by forming a silicon oxide film in a thickness of 400 nanometers by plasma-enhanced chemical vapor deposition (PECVD). A patterning portion is included therein but not illustrated. Subsequently, an amorphous silicon film is formed as a first sacrificial layer 105. A film thickness of the first sacrificial layer 105 corresponds to a depth of the concave portion. A thickness of the first sacrificial layer 105 is 30 nanometers.

Figure 11C:
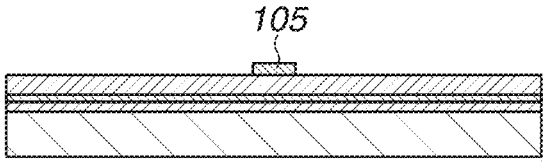
Figure 11D:
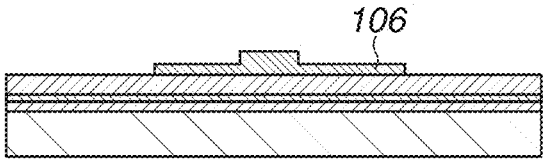

Patterning is performed on the first sacrificial layer 105 to form a portion corresponding to the concave portion. FIG. 11C illustrates patterning of the first sacrificial layer 105. FIG. 11D illustrates a forming process of a second sacrificial layer 106. An amorphous silicon film is formed in a thickness of 300 nanometers by PECVD and subjected to patterning to a size of a vibrating membrane to be formed.

Figure 11E:
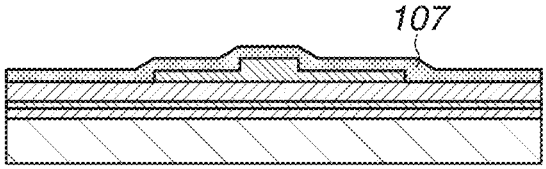

FIG. 11E illustrates forming of a first layer 107 of a second insulating film. A silicon nitride film is formed in a thickness of 30 nanometers by PECVD.

Figure 11F:
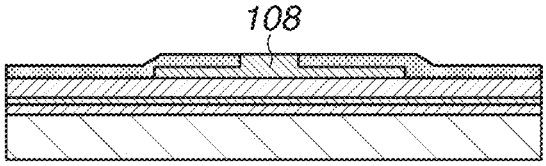

The first layer 107 of the second insulating film formed above an overlapping portion of the first sacrificial layer 105 and the second sacrificial layer 106 is removed by etching or chemical mechanical polishing (CMP). In FIG. 11F, a height of a sacrificial layer exposed portion 108 is coincided with the surrounding first layer 107 of the second insulating film, and therefore flatness of upper films is maintained.

Figure 11G:
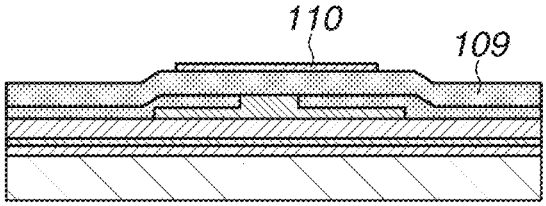

FIG. 11G illustrates a forming process of a second layer 109 of the second insulating film and a second electrode 110. A silicon nitride film is formed in a thickness of 570 nanometers by PECVD. Subsequently, the second electrode 110 is formed by forming an aluminum-neodymium alloy film in a thickness of 100 nanometers by sputtering.

Figure 11H:
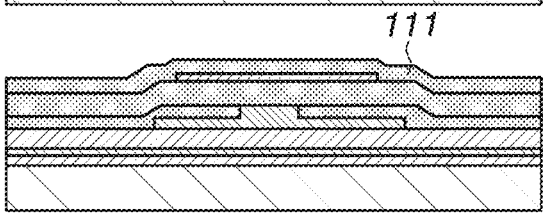
Figure 11I:
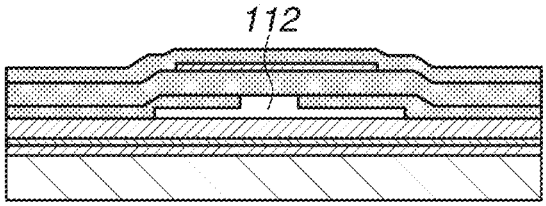

Subsequently, in FIG. 11H, a third insulating film 111 is formed by forming a silicon nitride film in a thickness of 400 nanometers by PECVD. A hole is formed on a part of the second insulating film and the third insulating film to remove the sacrificial layers 105 and 106 (not illustrated). Subsequently, the amorphous silicon forming the sacrificial layers 105 and 106 is removed by dry etching using xenon difluoride, and the air gap including a concave portion 112 is formed.

The etching hole used for etching of the sacrificial layer is then sealed by silicon nitride by PECVD. In this regard, a condition for film forming is an atmosphere in about 200 pascals, and the air gap is depressurized and sealed. At the time of sealing, silicon nitride laminated on the vibrating membrane is removed by etching in some cases. In a case where a considerable film thickness is required for a sealing process, an etching stop layer is formed on the third insulating film 111 before etching of the sacrificial layer, and the etching stop layer is removed after etching of the sacrificial layer, sealing, and etching of a sealing film.

An ultrasonic wave transducer which has a concave portion on a vibrating membrane and has high long-term reliability can be provided by the method for manufacturing the capacitive ultrasonic transducer according to the present extemporary embodiment.

An example of a method for manufacturing a capacitive ultrasonic transducer according to an eighth exemplary embodiment is described with reference to FIGS. 12A to 12H. The capacitive ultrasonic transducer manufactured according to the present exemplary embodiments corresponds to the one illustrated in FIG. 2. A top view is the same as FIG. 1A.

Figure 12A:
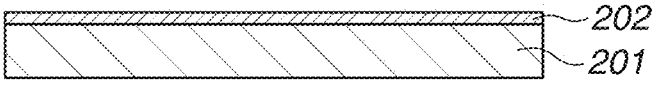
FIGS. 12A to 12H are diagrams illustrating an example of a method for manufacturing a CMUT according to an eighth exemplary embodiment.

In FIG. 12A, a silicon single crystal substrate 201 is subjected to thermal oxidation, to form a silicon oxide film 202 having a thickness of one micrometer. In the thermal oxidation process, a substrate surface is entirely oxidized, but a rear surface side of which description is omitted here is not illustrated in FIG. 12A.

Figure 12B:
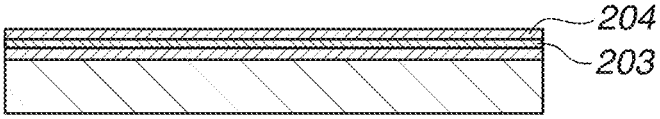

Next, as illustrated in FIG. 12B, a tungsten film having a thickness of 100 nanometers and a titanium film having a thickness of 10 nanometers are sequentially formed by sputtering, and a first electrode 203 is formed by performing photolithography and patterning processes. The first electrode 203 is uniform in FIG. 11B but is actually subjected to pattern forming. Subsequently, a first insulating film 204 is formed by forming a silicon oxide film in a thickness of 370 nanometers by PECVD. A patterning portion is included therein but not illustrated.

Figure 12C:
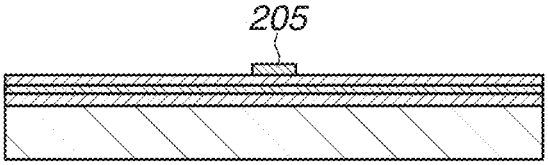

Subsequently, an amorphous silicon film is formed as a first layer 205 of a sacrificial layer. A film thickness of the first layer 205 corresponds to a depth of the concave portion. A thickness of the first layer 205 of the sacrificial layer is 30 nanometers. Patterning is performed on the first layer 205 of the sacrificial layer to form a portion corresponding to the concave portion. FIG. 12C illustrates patterning of the first layer 205.

Figure 12D:
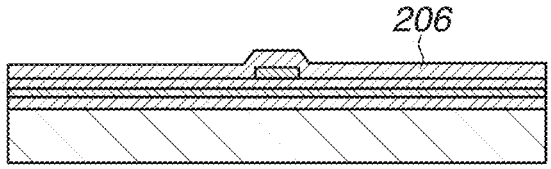
Figure 12E:
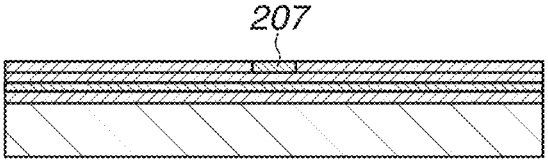

In FIG. 12D, a first layer 206 of a first insulating layer is formed by forming a silicon oxide film in a thickness of 30 nanometers by PECVD. Subsequently, the first layer 206 of the first insulating layer on the first layer 205 of the sacrificial layer is removed by etching or CMP. In this regard, a height of the first layer 205 of the sacrificial layer is coincided with a height of the surrounding first layer 206 of the first insulating layer, and therefore flatness of upper films is maintained.

Figure 12F:
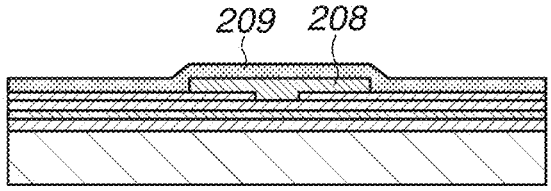
Figure 12G:
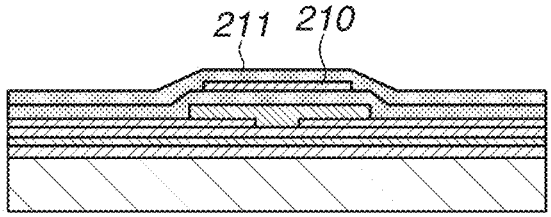
Figure 12H:
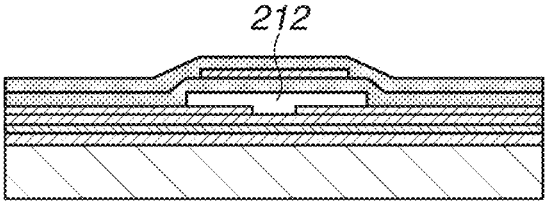

FIG. 12F illustrates a forming process of the sacrificial layer and forming of a second insulating film. A second layer 208 of the sacrificial layer is formed by forming an amorphous silicon film in a thickness of 300 nanometers by PECVD and performing patterning thereon to form the shape of the vibrating membrane. Subsequently, a second insulating layer 209 is formed by forming a silicon nitride film in a thickness of 600 nanometers by PECVD. Subsequent processes are the same as those of the seventh exemplary embodiment.

In the method for manufacturing the CMUT according to the present exemplary embodiment, forming of the vibrating membrane is not complicated after forming of the sacrificial layers 207 and 208, and thus more uniform characteristics can be expected among elements. In addition, an ultrasonic wave transducer which has a concave portion on a first insulating film and has high long-term reliability can be provided as with the above-described exemplary embodiment.

Figure 13:
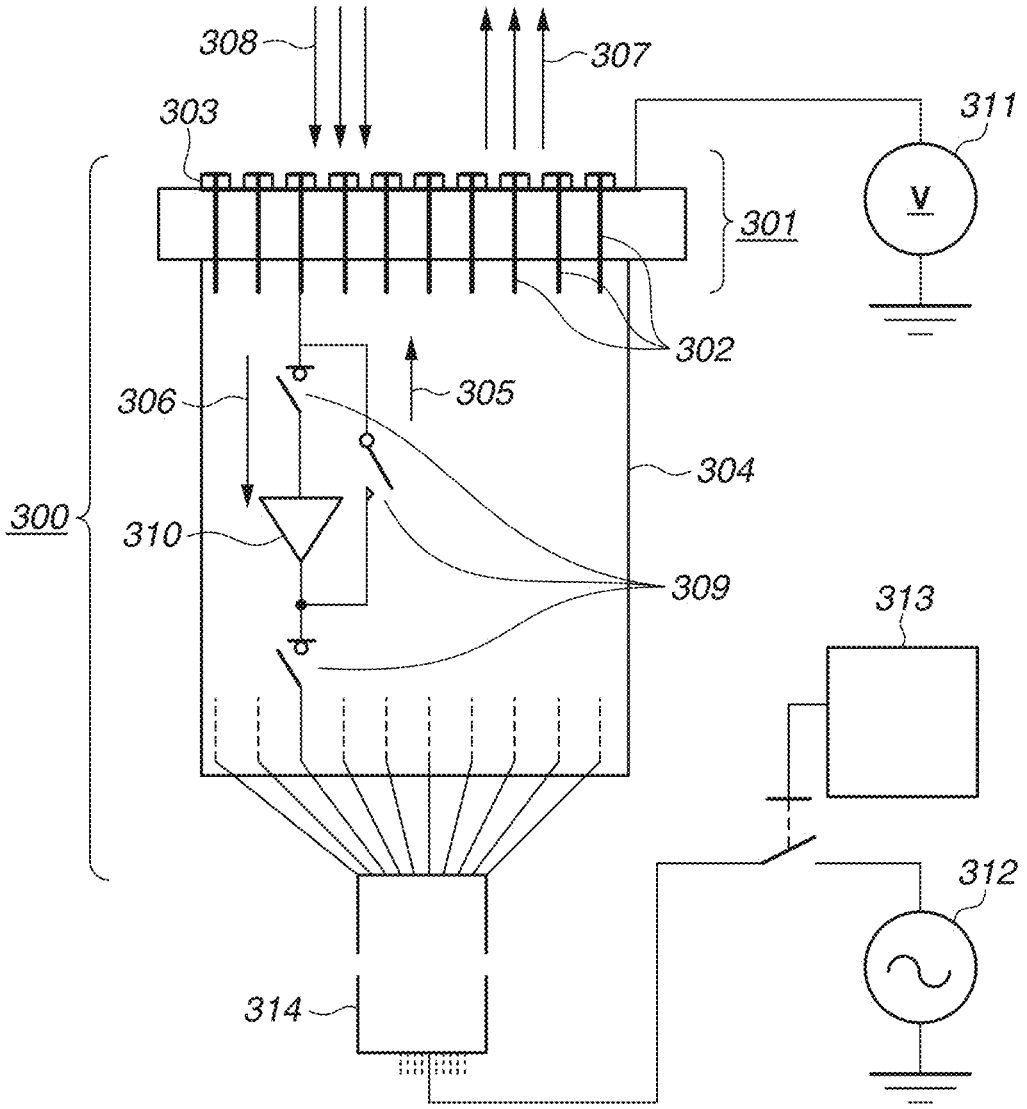
FIG. 13 is a diagram illustrating an example of an ultrasonic probe according to a ninth exemplary embodiment.

An ultrasonic probe according to a ninth exemplary embodiment is described with reference to FIG. 13.

The ultrasonic probe according to the present exemplary embodiment includes an array element in which a plurality of the above-described CMUTs is provided on a same substrate. The array element is connected to an electric substrate by a wire for each of the CMUTs, and the electric substrate includes thereon a switch which is switched in transmission and reception of an ultrasonic wave and an amplifier which amplifies an electrical signal converted when the ultrasonic wave is received.

Configurations of a CMUT 301 and an element 303 used in an ultrasonic probe 300 according to the present exemplary embodiment are similar to those in the first to sixth exemplary embodiments. The CMUT 301 is applied with a DC voltage from a DC power applying unit 311. A wire 302 is connected to an electric substrate 304 from each element 303, and a transmission signal 305 or a reception signal 306 is transmitted or received by each element 303. An ultrasonic wave 307 is transmitted in response to the transmission signal 305, an incident ultrasonic wave 308 is electrically converted by the element 303, and thus the reception signal 306 is generated. The electric substrate 304 includes an amplifier 310 which amplifies the reception signal thereon. The amplifier 310 is protected by switches 309 in transmission. The electric substrate 304 is connected to a cable 314, and the transmission signal 305 and the reception signal 306 of each element are exchanged with the outside of the probe. In a case where an ultrasonic wave is transmitted, an AC voltage is generated by an AC voltage applying unit 312 and input to the element 303 by passing through the cable 314 and bypassing the amplifier 310, and the ultrasonic wave 307 is transmitted. Meanwhile, in a case where an ultrasonic wave is received, the reception signal 306 is generated by each element 303 based on the incident ultrasonic wave 308 and transmitted to an information obtainment unit 313 via the cable 314.

The CMUT according to the present exemplary embodiment is installed in an ultrasonic probe, and therefore an ultrasonic probe having high long-term reliability can be provided.

In the CMUT according to the present exemplary embodiments, if an amplitude of the vibrating membrane is increased to a degree in which the vibrating membrane comes into contact with a surface at a bottom of an air gap, the vibrating membrane does not directly come into contact with the surface at the bottom of the air gap at the maximum displacement portion since the concave portion is formed on the insulating film. Therefore, a large amplitude can be realized without suppression of a vibration amplitude by a convex portion, and an ultrasonic wave having an adequate sound pressure can be generated. Further, since the vibrating membrane comes into contact with the insulating film at a surrounding portion of the concave portion, and a contact area is reduced, charging can be reduced. Accordingly, a high output CMUT which can reduce charging can be provided.

While the disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2018-105483, filed May 31, 2018, which is hereby incorporated by reference herein in its entirety.

What is claimed is:

1. A capacitive micromachined ultrasonic transducer (CMUT) comprising:

a first electrode;

a first insulating film on the first electrode; and a vibrating membrane across an air gap from the first insulating film, wherein the vibrating membrane includes a second electrode and a second insulating film at a position facing the air gap, wherein a concave portion is formed on either one of a surface of the first insulating film facing the air gap and a surface of the second insulating film facing the air gap, and wherein, when a region size of the surface facing the air gap of said one of the first insulating film and the second insulating film on which the concave portion is formed is defined as A, a size of a region where the concave portion is formed, defined as B, is smaller than a size of a region where the concave portion is not formed, defined as A-B.

2. The CMUT according to claim 1, wherein the concave portion is in a region including a position at which displacement of the vibrating membrane is largest, from a direction perpendicular to a surface facing the air gap.

3. The CMUT according to claim 1, wherein a shape of the concave portion is any of circular, rectangular, and elliptical, from a direction perpendicular to a surface facing the air gap.

4. The CMUT according to claim 1, wherein a shape of the vibrating membrane is circular from a direction perpendicular to a surface facing the air gap, and wherein the concave portion is in a region including a center of the vibrating membrane.

5. The CMUT according to claim 1, wherein a shape of the vibrating membrane is rectangular from a direction perpendicular to a surface facing the air gap, and wherein the concave portion is in a region including an intersection of diagonal lines of the vibrating membrane.

6. The CMUT according to claim 1, wherein the first insulating film includes silicon oxide, and the second insulating film includes silicon nitride.

7. The CMUT according to claim 1, wherein both of the first insulating film and the second insulating film include silicon oxide.

8. The CMUT according to claim 1, wherein the concave portion is on the first insulating film and not on the second insulating film, and the second electrode has an opening portion, and wherein the opening portion is at least in a region in which the concave portion is, from a direction perpendicular to a surface facing the air gap.

9. The CMUT according to claim 8, wherein from a direction perpendicular to a surface facing the air gap, a protrusion is on the surface of the second insulating film facing the air gap and on a position overlapping with the concave portion, wherein the protrusion is an insulator.

10. The CMUT according to claim 1, wherein the concave portion is on the second insulating film and not on the first insulating film, and the first electrode has an opening portion, and wherein the opening portion is at least in a region in which the concave portion is, from a direction perpendicular to a surface facing the air gap.

11. The CMUT according to claim 10, wherein a protrusion is on the surface of the first insulating film facing the air gap and on a position overlapping with the concave portion, from a direction perpendicular to a surface facing the air gap.

12. The CMUT according to claim 1, wherein a protrusion is on either one of the surface of the first insulating film facing the air gap and the surface of the second insulating film facing the air gap, and wherein the protrusion is on a position overlapping with the concave portion, from a direction perpendicular to a surface facing the air gap.

13. The CMUT according to claim 1, wherein the concave portion is on the surface of the second insulating film facing the air gap.

14. The CMUT according to claim 1, wherein the concave portion is on the surface of the first insulating film facing the air gap.

15. The CMUT according to claim 1, wherein the first electrode is on a substrate.

16. The CMUT according to claim 1, further comprising a third insulating film on the second insulating film.

17. The CMUT according to claim 1, further comprising a voltage applying unit configured to apply a voltage between the first electrode and the second electrode.

18. An ultrasonic probe comprising:

a reception unit configured to receive an ultrasonic wave irradiated on an object and output a reception signal; and an information obtainment unit configured to obtain information of the object based on at least the reception signal, wherein the reception unit includes the CMUT according to claim 1.

19. An ultrasonic probe comprising:

an array element including a plurality of the CMUTs according to claim 1 provided on a same substrate, wherein the array element is connected to an electric substrate by a wire for each of the CMUTs, wherein the electric substrate includes thereon a switch configured to be switched in transmission and reception of an ultrasonic wave and an amplifier configured to amplify an electrical signal converted in reception of an ultrasonic wave.

20. A method for manufacturing a capacitive micromachined ultrasonic transducer (CMUT), the method comprising:

forming a first insulating film on a first electrode;

forming a sacrificial layer on the first insulating film;

forming a second insulating film on the sacrificial layer;

forming a second electrode on the second insulating film;

forming an etching hole by removing a part of the second insulating film to expose a part of the sacrificial layer; and forming an air gap by removing the sacrificial layer, wherein the sacrificial layer is formed in such a manner that by removing the sacrificial layer, a concave portion is formed on a surface of the second insulating film facing the air gap, and wherein, when a region size of the surface facing the air gap of said one of the first insulating film and the second insulating film on which the concave portion is formed is defined as A, a size of a region where the concave portion is formed, defined as B, is smaller than a size of a region where the concave portion is not formed, defined as A-B.

21. The method according to claim 20, wherein the sacrificial layer includes a first sacrificial layer and a second sacrificial layer, wherein the second insulating film includes a first layer and a second layer, wherein the forming of the sacrificial layer includes forming the first sacrificial layer and forming the second sacrificial layer on the first sacrificial layer to cover the first sacrificial layer, and wherein the forming of the second insulating film includes, after forming the first layer of the second insulating film, removing a part of the first layer of the second insulating film to expose the first sacrificial layer, and forming the second layer of the second insulating film on the exposed first sacrificial layer.

22. A method for manufacturing a capacitive micromachined ultrasonic transducer (CMUT), the method comprising:

forming a first insulating film on a first electrode;

forming a sacrificial layer on the first insulating film;

forming a second insulating film on the sacrificial layer;

forming a second electrode on the second insulating film;

forming an etching hole by removing the second insulating film to expose a part of the sacrificial layer; and forming an air gap by removing the sacrificial layer, wherein the sacrificial layer is formed in such a manner that by removing the sacrificial layer, when a region size of the surface facing the air gap of said one of the first insulating film and the second insulating film on which the concave portion is formed is defined as A, a size of a region where the concave portion is formed, defined as B, is smaller than a size of a region where the concave portion is not formed, defined as A-B.

23. The method for manufacturing the CMUT according to claim 22, wherein the first insulating film includes a first layer and a second layer, wherein the sacrificial layer includes a first sacrificial layer and a second sacrificial layer, and wherein the method further comprises:

forming the first layer of the first insulating film;

forming the first sacrificial layer on the first layer of the first insulating film;

forming the second layer of the first insulating film on the first sacrificial layer to cover the first sacrificial layer;

removing a part of the second layer of the first insulating film to expose the first sacrificial layer; and forming the second sacrificial layer on the exposed first sacrificial layer.

24. The method for manufacturing the CMUT according to claim 20, further comprising forming the first electrode on a substrate.

25. The method for manufacturing the CMUT according to claim 20, wherein the first insulating film includes silicon oxide, and the second insulating film includes silicon nitride.

26. The method for manufacturing the CMUT according to claim 20, wherein both of the first insulating film and the second insulating film include silicon oxide.

27. The method for manufacturing the CMUT according to claim 20, further comprising forming a third insulating film on the second electrode.

28. The method for manufacturing the CMUT according to claim 20, further comprising forming a fourth insulating film on the third insulating film, the fourth insulating film sealing the etching hole.

* * * * *